US009463392B2

(12) United States Patent
Bella-Martorell

(10) Patent No.: US 9,463,392 B2
(45) Date of Patent: Oct. 11, 2016

(54) PLAYING FIGURE

(71) Applicant: MAGIC BOX INT. TOYS, S.L.U., Barcelona (ES)

(72) Inventor: David Bella-Martorell, Barcelona (ES)

(73) Assignee: MAGIC BOX INT. TOYS, S.L.U., Barcelona (ES)

( * ) Notice: Subject to any disclaimer, the term of this patent is extended or adjusted under 35 U.S.C. 154(b) by 0 days.

(21) Appl. No.: 14/481,082

(22) Filed: Sep. 9, 2014

(65) Prior Publication Data

US 2015/0118934 A1 Apr. 30, 2015

(30) Foreign Application Priority Data

Oct. 30, 2013 (ES) ..... 201331249 U

(51) Int. Cl.

*A63H 3/36* (2006.01)
*A63F 3/00* (2006.01)
*A63H 3/00* (2006.01)

(52) U.S. Cl.

CPC ..... *A63H 3/00* (2013.01); *A63F 3/00697* (2013.01); *A63F 2003/00747* (2013.01); *A63F 2003/00883* (2013.01)

(58) Field of Classification Search

CPC ..... A63H 3/00; A63H 3/36; A63H 3/50; A63H 13/00; F16M 11/00; F16M 13/00; F16M 2200/00; F16M 2200/08

USPC ..... 446/268, 325, 385, 486; 248/127, 248/163.1, 346.01

See application file for complete search history.

(56) References Cited

U.S. PATENT DOCUMENTS

| | | | | |
|---|---|---|---|---|
| 1,557,637 | A * | 10/1925 | Warner | 446/268 |
| 5,322,036 | A * | 6/1994 | Merino | 119/707 |
| 7,287,474 | B2 * | 10/2007 | Whitley | 102/358 |
| 7,726,621 | B1 * | 6/2010 | Dellinger | 248/346.5 |

* cited by examiner

*Primary Examiner* — Kien Nguyen
(74) *Attorney, Agent, or Firm* — Hoglund & Pamias, PSC; Robert J Rios

(57) ABSTRACT

The playing figure of the invention, consists in a body of small dimensions which is the likeness of a puppet, an object or any other geometrical form as well as support means for lying on the ground or on a surface, permitting the stable arrangement of the figure in predetermined positions, particularly in an upright position and in predetermined tumbled positions.

15 Claims, 2 Drawing Sheets

PLAYING FIGURE

FIELD OF THE INVENTION

The invention refers to a playing figure, consisting in a body of small dimensions, which may have various configurations or shapes and some means for the support of the figure on the ground or on a surface. This figure has specific characteristics concerning the means for supporting the same which permit to define certain determined positions for its stable support: one of them is an upright position and various others are tumbled positions of the figure.

BACKGROUND OF THE INVENTION

There are currently on the market various figures for playing with small dimensions, which are adequate to be transported easily by boys in the hand or in a pocket, these figures having generally a body which is the likeness of any object, a humanoid figure or any other, as well as support means for lying on the ground or on a surface.

"In these figures for playing, the support means are formed by a flat surface which may be defined on the body of the toy itself, as happens in the figure described in the Spain utility model with application number U200402725, or may be formed by a flat platform as shown as "an example in the application for Spain utility model U200201239.

In both cases the only function of said support means is to keep the figure for playing more or less stable in upright or vertical position, said support means constituting eventually a hindrance during the play with the figure.

Therefore, the technical problem which emerges is the development of a figure for playing in which the support means have adequate characteristics to contribute an additional functionality to that of keeping the figure upright.

SUMMARY OF THE INVENTION

The playing figure which is the subject matter, of the invention, consists in a body of small dimensions which is the likeness of a puppet, an object or any other geometrical form as well as support means for lying on the ground or on a surface, having construction peculiarities concerning the support means, which are aimed to solve the above stated problems and precisely to permit the stable arrangement of the figure in predetermined positions, particularly in an upright position and in predetermined tumbled positions.

To reach these objectives, the support means consist in a flattened base adequate to support the body of the puppet, having said flat base at its periphery at least three downwardly directed curved extensions, which ends are arranged in the same plane, forming a surface for supporting the figure in an upright position.

At least part of said extensions protrude laterally from the vertical projection of the body of the puppet, so that the ends of the subsequent extensions form together with the body of the figure some means for the stable support of the figure in predetermined tumbled positions.

These features permit that during the course of the game the figures may be thrown away, ending at random in an upright or in tumbled positions within a limited number of predetermined positions. This permits to increase the competitiveness of the game using as a variable the final position of the figure.

According to the invention, the base has a bottom surface adequate for the incorporation or definition of respective digit signals, characters or motives of identification, which are adequate to clearly differentiate the eventual positions of the figure when this latter is in a tumbled position.

In a preferred embodiment of the invention the flat base has a triangular configuration according to a top view, with curved-concave sides and comprises three extensions in correspondence respectively to the vertex points of the base, forming said extensions by themselves, support means of the figure in upright position and, in combination with the body of the figure, some means for the stable disposition of the figure in one of three predetermined tumbled positions.

BRIEF DESCRIPTION OF THE DRAWINGS

To complete this description and with the purpose to facilitate the understanding of the features of the invention, drawings are annexed, in which in an illustrative but not limitative form the following has been shown.

DETAILED DESCRIPTION OF THE INVENTION

Figure 1:
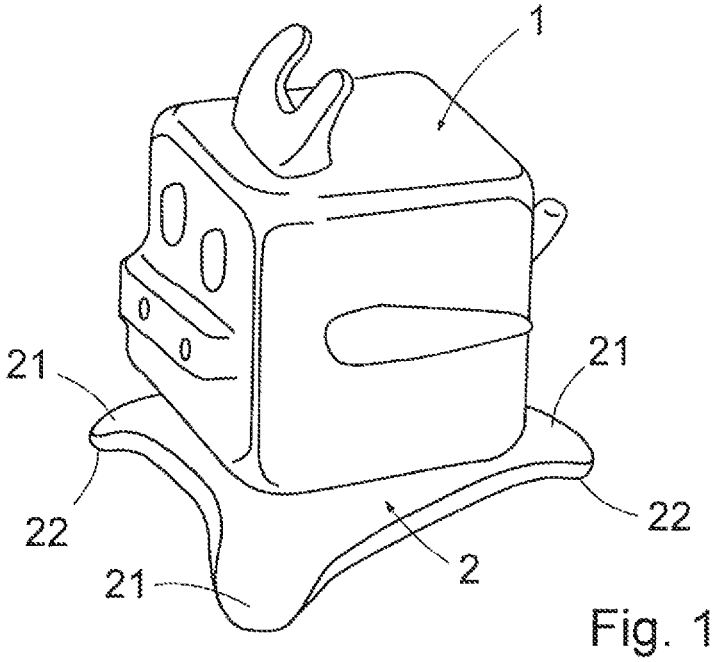
FIG. 1 shows a perspective view of an exemplary embodiment of the playing figure according to the invention, the body consisting in a fancy puppet figure.
Figure 2:
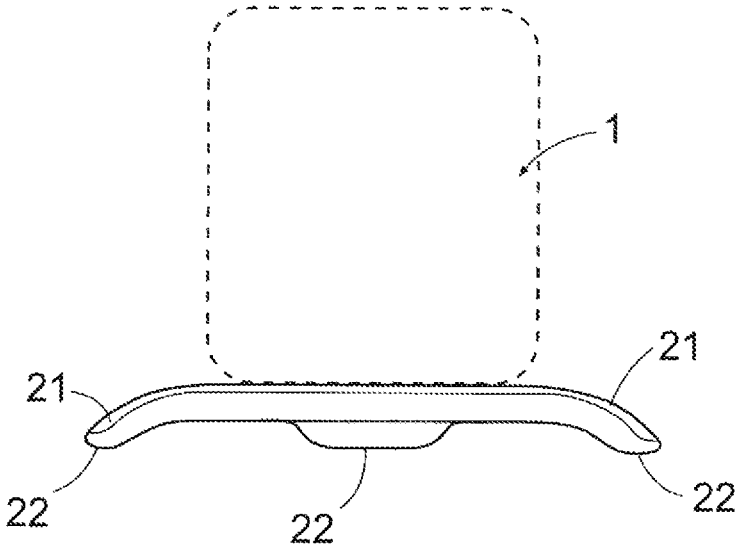
FIG. 2 shows views in form of a frontal view of the playing figure according to the invention, in which the body of the figure has been only diagrammatically shown with dotted lines, to facilitate the observation of the features of the base of the figure to which the invention refers.

As may be observed in FIG. 1, the playing figure according to the invention consists in a body (1) assembled on a flat base (2), in this case a triangular base which has in its periphery and precisely in correspondence with the vertexes of said triangular base, three extensions (21) directed downwardly, which ends (22) are arranged in the same plane forming support means to keep the playing figure in upright position.

As may be observed in the accompanying drawings, the extensions (21) of the base protrude sideways in respect of the vertical projection of the body (1) of the figure, in a form in which the ends (22) of said extensions, combined with the body (1), permit that the playing figure may be arranged tumbled in a stable form in various predetermined positions; precisely in three positions, each one of them corresponding to one of the faces of the base (2).

This allows that when in the course of the game the figure is thrown away, it may end up in upright position being supported on the ends (22) of the extensions (21) or tumbled in three different positions being supported in each of the positions by the body (1) and a consecutive pair of the ends (22) of the extensions (21).

In case that the figure ends up in a tumbled position, two extensions (21) will be directed downwardly contacting the ground or support surface, while the other extension (21) will be directed upwards.

Figure 3:
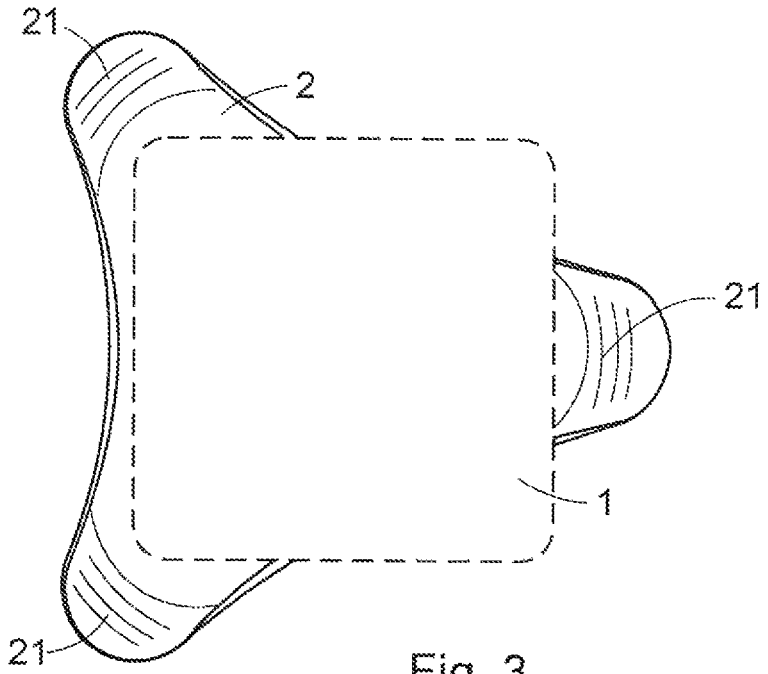
FIG. 3 shows views in form of a top view of the playing figure according to the invention, in which the body of the figure has been only diagrammatically shown with dotted lines, to facilitate the observation of the features of the base of the figure to which the invention refers.
Figure 4:
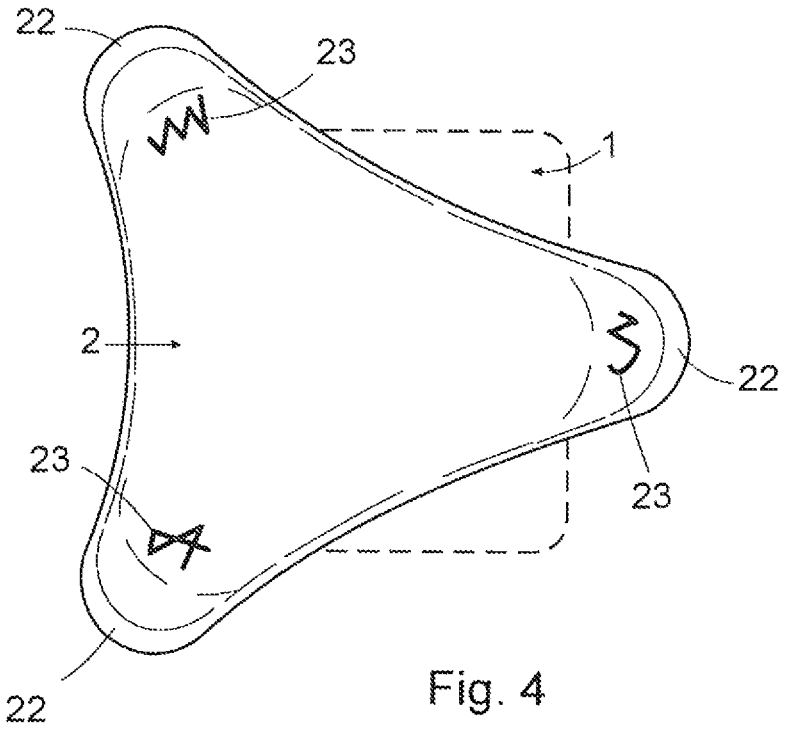
FIG. 4 shows views in form of a bottom view of the playing figure according to the invention, in which the body of the figure has been only diagrammatically shown with dotted lines, to facilitate the observation of the features of the base of the figure to which the invention refers.

As shown in FIG. 3, with the purpose to increase the playing possibilities it has been provided that the base (2)

has in its lower surface and in the vicinity of the ends (22) corresponding digit figures (23) or identification motives permitting to differentiate the positions of the figure when it is in a tumbled position.

Having sufficiently described the nature of the invention, as well as an example of a preferred embodiment, it is stated to all appropriate purposes that the materials, shape, size and arrangement of the elements described can be modified, provided that this does not alter the essential characteristics of the invention claimed as follows.

The invention claimed is:

1. A playing figure having a body (1) of small dimensions and means to be supported on the ground or on a support surface, said figure comprising:

a support means having a solid flattened base (2) configured to support a bottom portion of the body of the playing figure, said flattened base (2) has on its periphery at least three downwardly curved extensions (21) having coplanar ends (22); at least a part of the downwardly curved extensions (21) of said base protrude sideways with respect to a vertical projection of the body (1); the ends (22) of the extensions (21) forming respective support means for the figure in upright position, and providing together with the body (1) support means for the disposition of the figure in predetermined positions when tumbled.

2. The playing figure of claim 1, wherein visual indicia is provided on a bottom surface of said base in the vicinity of said ends (22) of the extensions (21).

3. The playing figure of claim 2, wherein said visual indicia comprises at least one of: digit figures (23), identification characters or motives.

4. The playing figure of claim 3, wherein said base (2) has a triangular configuration with curved-concave sides when viewed from the top and comprises three extensions (21) arranged in correspondence with the vertexes of said base.

5. The playing figure of claim 1, wherein said base (2) has a triangular configuration with curved-concave sides when viewed from the top and comprises three extensions (21) arranged in correspondence with the vertexes of said base.

6. The playing figure of claim 2, wherein said base (2) has a triangular configuration with curved-concave sides when viewed from the top and comprises three extensions (21) arranged in correspondence with the vertexes of said base.

7. A playing figure having a body (1) of small dimensions and means to be supported on the ground or on a support surface, said figure comprising:

a support means having a continuous solid flattened base (2) configured to support a bottom portion of the body of the playing figure, said continuous flattened base (2) has on its periphery at least three downwardly curved extensions (21) having coplanar ends (22); at least a part of the downwardly curved extensions (21) of said base protrude sideways with respect to a vertical projection of the body (1); the ends (22) of the extensions (21) forming respective support means for the figure in upright position, and providing together with the body (1) support means for the disposition of the figure in predetermined positions when tumbled.

8. The playing figure of claim 7, wherein visual indicia is provided on a bottom surface of said base in the vicinity of said ends (22) of the extensions (21).

9. The playing figure of claim 8, wherein said visual indicia comprises at least one of: digit figures (23), identification characters or motives.

10. The playing figure of claim 9, wherein said base (2) has a triangular configuration with curved-concave sides when viewed from the top and comprises three extensions (21) arranged in correspondence with the vertexes of said base.

11. The playing figure of claim 8, wherein said base (2) has a triangular configuration with curved-concave sides when viewed from the top and comprises three extensions (21) arranged in correspondence with the vertexes of said base.

12. The playing figure of claim 7, wherein said base (2) has a triangular configuration with curved-concave sides when viewed from the top and comprises three extensions (21) arranged in correspondence with the vertexes of said base.

13. A playing figure having a body (1) of small dimensions and means to be supported on the ground or on a support surface, said figure comprising:

a support means having a solid flattened base (2) including on its periphery at least three downwardly curved extensions (21), said solid flattened base (2) comprising an upper surface, a lower surface and inwardly curved lateral surfaces longitudinally extending between said downwardly curved extensions and between said upper and lower surfaces; ends (22) of the extensions (21) forming respective support means for the figure in upright position, and providing together with the body (1) support means for the disposition of the figure in predetermined positions when tumbled.

14. The playing figure of claim 13, wherein visual indicia is provided on the bottom surface of said base in the vicinity of said ends (22) of the extensions (21).

15. The playing figure of claim 14, wherein said visual indicia comprises at least one of: digit figures (23), identification characters or motives.

* * * * *